United States Patent [19]

Gurley

[11] Patent Number: 4,750,760

[45] Date of Patent: Jun. 14, 1988

[54] SKI POLE GRIP

[76] Inventor: Mark L. Gurley, R.D. #8, Box 554, Meadville, Pa. 16335

[21] Appl. No.: 643

[22] Filed: Jan. 5, 1987

[51] Int. Cl.[4] ..... A63C 11/00

[52] U.S. Cl. ..... 280/821

[58] Field of Search ..... 280/821, 822

[56] References Cited

U.S. PATENT DOCUMENTS 3,992,021 11/1976 Tobin ..... 280/821

4,004,818 1/1977 Ramillon ..... 280/821

FOREIGN PATENT DOCUMENTS 2618723 11/1977 Fed. Rep. of Germany ..... 280/822

*Primary Examiner*—John J. Love

*Assistant Examiner*—Richard Camby

*Attorney, Agent, or Firm*—Charles L. Lovercheck; Wayne L. Lovercheck

[57] ABSTRACT

A ski pole grip made up of a cylindrical central body grip part having a hole therein for receiving a ski pole handle. The body grip part has an upper and a lower end and an intermediate part. The intermediate part is generally cylindrical and adapted to be received in a hand of a skier with the palm of the body a first side and the fingers extending around the second side of the intermediate part. A mushroom-like top part is integrally attached to the upper end of the hand engaging part and extends outward from the sides and front thereof. The front part of the mushroom-like top acts as a snow guard and is attached to the front side of the top and extends downward. A thumb support is attached to the inner side of the body part and extends upward and terminates in spaced relation to the upper end. A recess formed at the front of one side of the thumb support receives the ends of the skier's fingers. A hand support is attached to the lower part of the body part at the outer side and extends upwardly. The mushroom-like top upper guard is attached to the second side of snow guard, extending downwardly and terminating adjacent the upper end of the lower guard. The upper guard and the hand support are adapted to receive the hand of a skier therebetween with the hand resting on the lower guard.

15 Claims, 3 Drawing Sheets

SKI POLE GRIP

BACKGROUND OF THE INVENTION

Applicant has observed that the conventional ski pole grips provide little, if any, protection for the thumbs of a skier which are exposed and are injured in many skiing accidents. Because of the physical structure and anatomical location of the thumb it is especially vulnerable to injury, particularly when the skier is thrown forward. No prior ski pole grip is designed to adequately protect the thumb and hand.

STATEMENT OF THE INVENTION

The aspects of this invention are: (1) the thumb rest which holds the thumb in a natural position with the rest of the hand and prevents the thumb from being jammed back. It prevents the thumb and fingers from being bent down and back so that the knuckles will not be dislocated. It also protects the index finger from being crushed, (2) the mushroom shaped shield or snow guard that extends out over the front and sides of the pole protects the thumb from being indured from above, (3) the undercut recess in the thumb support member below the thumb support surface saves material in the manufacturing process and provides a space for the tips of the skier's fingers which curve around the cylindrical grip, and (4) the guard that goes around the back of the hand replace the conventional leather straps. The lower extension is relatively stiff, flat, and provides a rest for the hand while planting a ski pole.

The primary purpose of the improved ski pole grip is to protect the thumb and hand of the skier. The thumb guard will keep the thumb of the skier on the thumb support against the body of the grip when the skier's hand impacts with the ski slope and other obstacle thus preventing the thumb from being broken and prevents other injuries to the skier's hand. The raised grip which merges into the guard is intended to hold the thumb stationary during the time that the thumb is against the body of the grip and to keep the thumb from being bent back by impact thereby breaking or fracturing the thumb.

The mushroom shaped snow guard has a generally convex top and concave bottom with its central part attached to the upper end of the cylindrical body. The snow guard extends out and down over the front and sides of the hand and is designed to protect the knuckles of the first two fingers of the hand and to prevent the thumb from striking with a direct impact and jamming the knuckles backwards. Very little of the mushroom shaped snow guard extends rearward beyond the hand grip so as not to interfere with the hand at that part.

The raised portion in the grip, or rearwardly extending protrusion, in addition to helping hold the thumb in place, also helps hold the pole out so that when the skier is reaching forward to plant his pole he does not have to turn his wrist up as fast and therefore releases pressure on the wrist itself.

REFERENCE TO PRIOR ART

Applicant is familiar with the following U.S. Pat. Nos.:

| | |
|---|---|
| 4,004,818 to Ramillon | 4,508,364 to Joseph |
| 4,288,102 to Ramer | 4,572,545 to Dooley, Jr. et al |

-continued

| | |
|---|---|
| 4,493,494 to Feagin, Jr. | 4,597,589 to Fujii et al |

None of the patents shows a thumb guard, or a snow guard such as Applicant has disclosed.

OBJECTS OF THE INVENTION

It is an object of the invention to provide an improved ski pole grip particularly shaped to protect the thumb of a skier.

Another object of the invention is to provide a ski pole grip especially suitable to protect the entire hand of the skier.

Another object of the invention is to provide an improved ski pole grip which is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction wihout departing from the spirit or sacrificing any of the advantages of the invention.

DETAILED DESCRIPTION OF THE DRAWINGS

Figure 2:
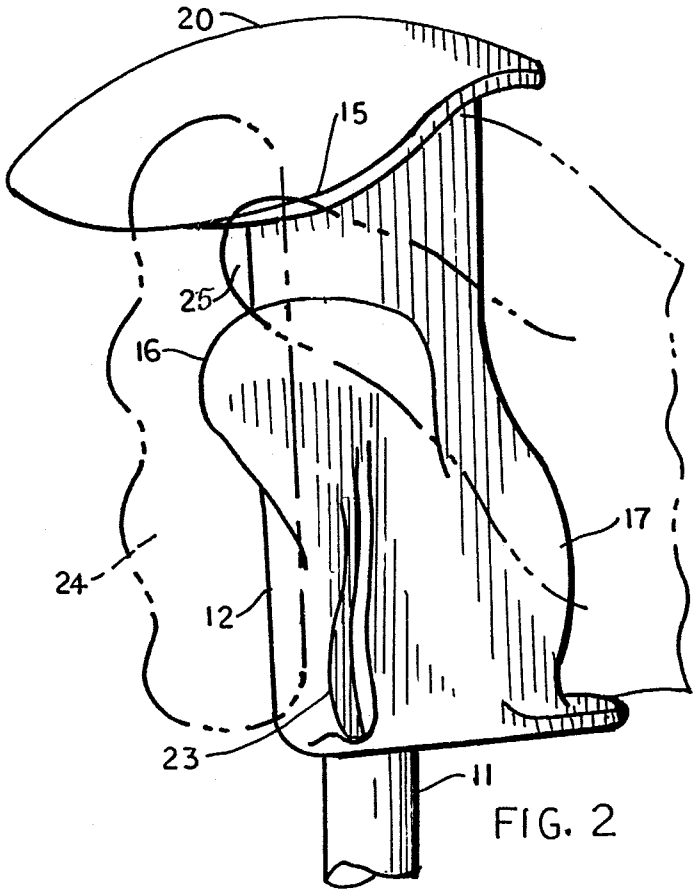
FIG. 2 is a left side view of the ski pole grip shown in FIG. 1 for the right hand.
Figure 1:
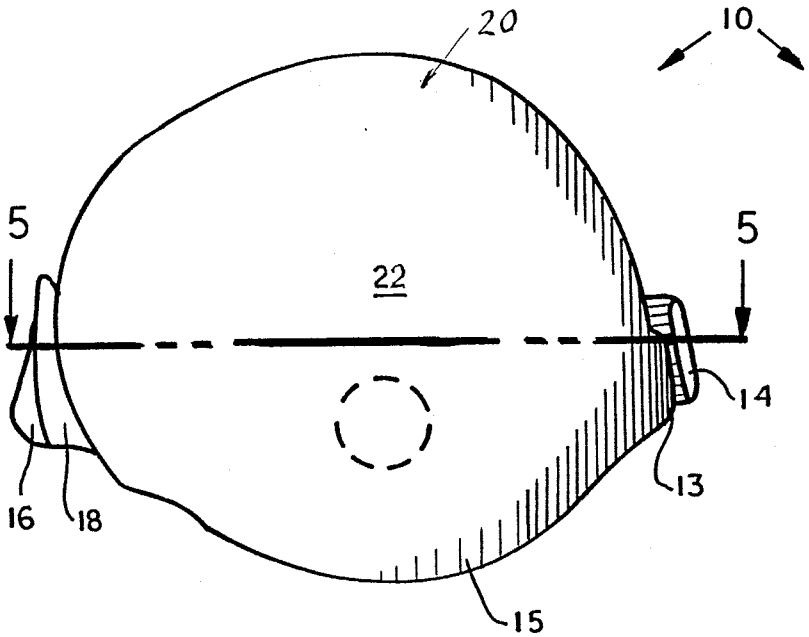
FIG. 1 is a top view of the ski pole grip according to the invention for the right hand.
Figures 3, 4:
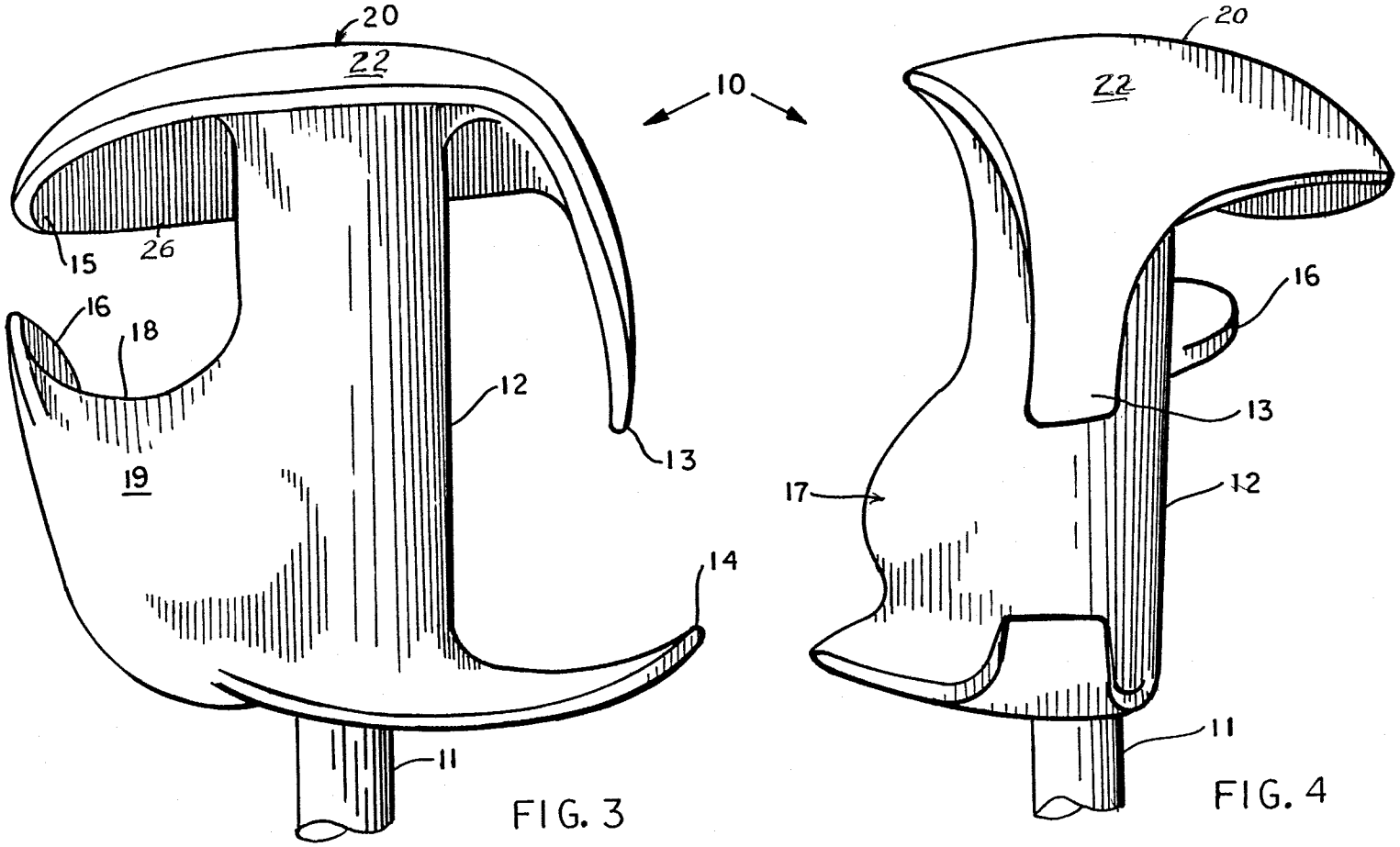
FIG. 3 is is a rear view of the ski pole grip for the right hand shown in FIGS. 1 and 2.
FIG. 4 is a right side view of the ski pole grip shown in FIGS. 1 to 3 for the right hand.
Figure 6:
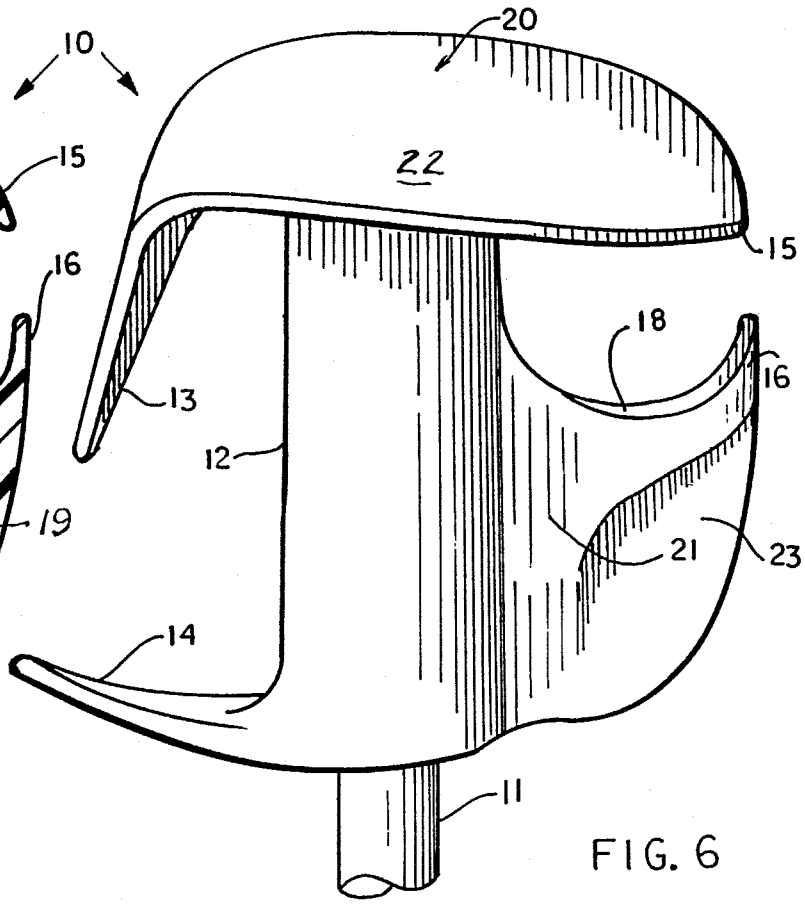
FIG. 6 is a front view of the ski pole grip shown in FIGS. 1 to 5.
Figure 5:
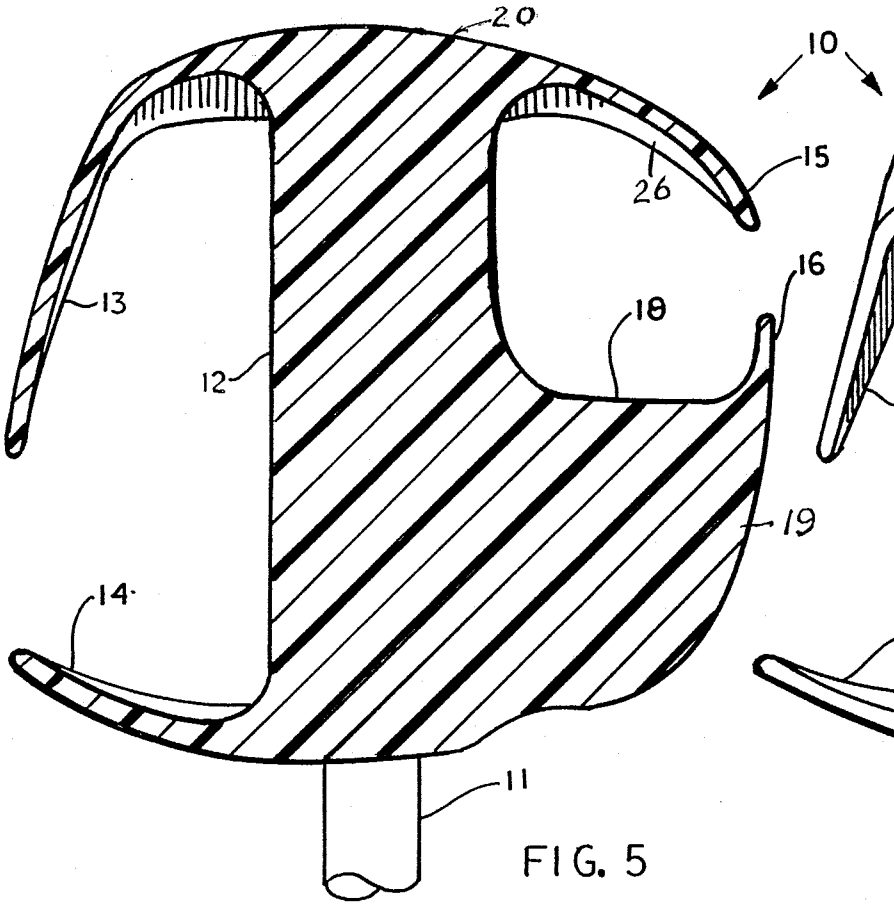
FIG. 5 is a cross sectional view taken on line 5—5 of FIG. 1.

Now with more particular reference to the drawings, the embodiment of the invention shown in FIGS. 1 through 6 shows a grip 10 for a ski pole 11 made up of generally elongated cylindrical body 12 having an upper end and a lower end. The lower end has means on it in the form of a hole to receive the upper end of the ski pole 11.

A mushroom shaped snow guard 20 has an upper convex surface 22 and a lower concave surface 26. The mushroom shaped snow guard 20 is integrally attached to the upper end of the generally cylindrical body 12 and extends foward and to both sides of the body 12. The peripheral edges of the mushroom shaped snow guard 20 extend downwardly, outwardly and overlie the thumb and hand of a skier.

A thumb support 19 is integrally fixed to the lower part and inner side of the cylindrical body 12 and extends inwardly toward the other hand and terminates in an upwardly facing thumb supporting surface 18 spaced from the upper end approximately half way along the cylindrical body 12.

The thumb support 19 is undercut on the front side 21, forming a recess 23, to receive the fingers 24 of a skier. As shown in FIG. 2, the fingers of a hand indicated at 24 may extend into recess 23 and thumb 25 may overlie thumb support surface 18. A rearwardly extending convex protrusion 17 is formed on thumb support 19. Protrusion 17 is generally hemispherical in shape and fits into the palm of the skier's hand. Protrusion 17 terminates on the thumb support surface 18 between the mushroom shaped snow guard 20 and the thumb support 19. Thus when a skier falls forward, the mushroom shaped snow guard 20 will engage the ground and protect the skier's thumb 25 and fingers 24 from injury.

A thumb guard 16 extends upwardly from the inner side of the thumb support surface 18 remote from the cylindrical body 12. Thumb guard 16 terminates in spaced relation and below a side edge 15 of the mushroom shaped snow guard 20. The overhanging part of the side edge 15 of the snow guard 20 prevents the snow from injuring the thumb supported on thumb support surface 18.

Hand support 14 is a relatively thin generally flat part integrally attached to the cylindrical body 12 and extends radially, outwardly from body 12 and terminates in a generally upwardly inclined surface adapted to support a hand. An overhanging part 13 of the mushroom shaped snow guard 20 terminates above and in spaced relation to the hand support 14 providing a space between the overhanging part 13 and the hand support 14 to receive a hand of a skier.

Generally the mushroom shaped snow guard 20 protects the thumb 25 from being jammed back. Mushroom shaped snow guard 20 also protects the index finger from being crushed when striking an object. Thumb support 19 holds the thumb in a natural position with the rest of the hand. The recess 23 below the thumb support surface 18 saves material in the manufacturing process of the ski pole grip and allows for fingertips to curve around the pole for the larger than average hand or for bulky gloves.

The traditional straps that go around the back of the hand are replaced by overhanging part 13 on the outer side of the grip 10. The protrusion 16 extends rearwardly of the grip with regard to a person using the grip. The word "forward" is also used herein with reference to the person using the grip.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A ski pole grip comprising:

a generally cylindrical central hand grip part having a first end and a second end, a first side and a second side, means on said second end for attaching said ski pole grip to a ski pole, said grip having a generally cylindrical intermediate part between said first end and said second end, said intermediate part being adapted to be received in the hand of a skier, a thumb support integrally attached to said cylindrical intermediate part and being disposed on said first side and extending radially outwardly from said first end toward said second end and terminating in spaced relation to said second end, an enlarged convex prortrusion integrally attached to said thumb support adjacent said first end and extending from said intermediate part outward and toward said second end, said protrusion extending rearwardly with regard to the person using the grip from said cylindrical central hand grip part, said thumb support having a thumb supporting surface extending upwardly, forwardly, and radially outwardly from said cylindrical central hand grip part and generally toward said first end, said thumb supporting surface being disposed adjacent to said first end merging into an upwardly facing surface adapted to have the thumb of a skier rest thereon, a thumb guard 16 integrally attached to said thumb support at a side of said upwardly facing surface remote from said cylindrical central hand grip part and extending toward said second end.

2. The ski pole grip recited in claim 1 wherein said convex protrusion is generally hemispherical in shape.

3. The ski pole grip recited in claim 2 wherein an undercut recess for receiving the ends of the skier's fingers is formed in said thumb support on the side remote from said thumb support surface, said thumb guard being adapted to protect the skier's thumb and limiting outward movement of the thumb on said thumb support surface.

4. The grip recited in claim 3 wherein a mushroom shaped top is integrally attached to said second end of said body and has a convex top surface attached to said first end of said generally cylindrical central grip part and spaced from said thumb support surface, said mushroom shaped top extending forward at both sides and downward and terminates in spaced relation to said thumb guard.

5. The grip recited in claim 1 wherein said mushroom shaped top is relatively thin and and has a convex lower surface.

6. The grip recited in claim 3 wherein a hand guard in the form of an extension on said top integrally attached to said mushroom shaped top at the side opposite said thumb guard, said hand guard extends down and overlies the hand of the skier on the side of said grip part remote from said thumb support, and a hand support is integrally attached to said second end of said grip part adjacent said second end, said hand support being adapted to underlie the hand of a skier.

7. The grip recited in claim 5 wherein an overhanging part is attached to said mushroom shaped top, a hand support is attached to said cylindrical hand grip part at said first end, said hand support extending outwardly from said second side, said hand support is relatively rigid, whereby said overhanging part can be swung outward away from said hand support to allow a hand to enter between said hand support and said overhanging part.

8. The grip recited in claim 6 wherein said recess is formed in said thumb support on the side of said thumb support remote from said thumb supporting surface, said recess being adapted to receive the fingers of a skier.

9. In combination a ski pole grip and a ski pole comprising a generally cylindrical body part having a first end and a second end and having an opening at its first end for receiving an end of said ski pole, said body part having an intermediate part between said first end and said second end, said intermediate part of said body part being adapted to be received in the hand of a skier, a thumb support member integrally attached to said second end of said body part and extending radially outward from said first end and generally toward said first end and having an upwardly facing surface spaced from said second end adapted to have the thumb of a skier rest thereon, said thumb support having a thumb guard at its side remote from said cylindricl body part and from said first end, an enlarged convex protrusion integrally attached to said thumb support adjacent said second end and extending from said intermediate part outward and toward said first end, said protrusion extending rearwardly, with regard to the person using the grip, from said cylindrical central hand grip part, said thumb guard joining said upwardly facing surface and extending therefrom toward said first end, an undercut recess in said thumb support on the front side thereof for receiving the ends of the skier's fingers and disposed below and on the side of said thumb support surface remote from said inclined surface.

10. The ski pole grip and ski pole recited in claim 8 wherein a thumb guard is integrally attached to said thumb support member and extends from said upwardly facing surface towards said first end, said guard being adapted to protect the skier's thumb and to prevent the thumb from moving outward away from said grip member.

11. The ski pole grip and ski pole recited in claim 9 wherein a mushroom shaped top is attached to said first end of said body part, said top extends downward and terminates adjacent said thumb guard 16, said mushroom shaped top having a convex top surface.

12. The ski pole grip and ski pole recited in claim 9 wherein a hand guard is integrally attached to said mushroom shaped top and extends outward and downward over the hand of a skier and overlies a part of the hand of the skier, and a second guard is attached to said second end of said body part and extends upwardly and outwardly to support the hand of the skier.

13. The ski pole grip and ski pole recited in claim 11 wherein a hand support is attached to said body adjacent said second end extends outwardly therefrom and is relatively rigid and an overhanging part is attached to said first end of said body and is relatively flexible, whereby said overhanging part can be swung outward to allow a hand to enter or leave from between said hand support and said overhanging part.

14. The ski pole grip and ski pole recited in claim 12 wherein said grip has a hole in its lower side for receiving a ski pole.

15. A ski pole grip comprising a generally cylindrical body member adapted to be received in the palm of a hand of a skier and having an upper end and a lower end, means on said body member for attaching said grip to a ski pole, a thumb support member integrally attached to said body member adjacent said second end and having an upwardly facing thumb supporting surface thereon, an enlarged convex protrusion integrally attached to said thumb support adjacent said second end and extending from said intermediate part outward and toward said first end, said protrusion extending rearwardly, with regard to a user of the grip, from said cylindrical central hand grip part, a thumb guard attached to said thumb support and extending upwardly from said surface, a convex mushroom shaped snow guard member attached to said upper end and extending radially forward and overlying said thumb support, inwardly and adapted to protect the thumb and fingers of said hand from impact against said snow, said snow guard member being integrally attached to said body member and terminating in spaced relation to said thumb guard.

* * * * *